US009715802B2

(12) United States Patent
Maggi

(10) Patent No.: US 9,715,802 B2
(45) Date of Patent: Jul. 25, 2017

(54) ALARMED THEFT-PREVENTING DEVICE

(71) Applicant: MAGGI CATENE S.P.A., Olginate LC (IT)

(72) Inventor: Corrado Maggi, Sirtori LC (IT)

(73) Assignee: MAGGI GROUP S.p.A., Olginate (IT)

( * ) Notice: Subject to any disclaimer, the term of this patent is extended or adjusted under 35 U.S.C. 154(b) by 68 days.

(21) Appl. No.: 14/405,487

(22) PCT Filed: Jun. 3, 2013

(86) PCT No.: PCT/IB2013/054566
§ 371 (c)(1),
(2) Date: Dec. 4, 2014

(87) PCT Pub. No.: WO2013/182971
PCT Pub. Date: Dec. 12, 2013

(65) Prior Publication Data

US 2015/0137975 A1 May 21, 2015

(30) Foreign Application Priority Data

Jun. 4, 2012 (IT) ..... MI20120213 U
Feb. 4, 2013 (IT) ..... MI20130036 U

(51) Int. Cl.
*G08B 13/14* (2006.01)
*E05B 45/00* (2006.01)
*E05B 45/06* (2006.01)

(52) U.S. Cl.
CPC ..... *G08B 13/14* (2013.01); *E05B 45/005* (2013.01); *E05B 2045/064* (2013.01); *E05B 2045/067* (2013.01)

(58) Field of Classification Search
CPC ..... G08B 13/14; E05B 67/00; E05B 45/005; Y01S 70/49
(Continued)

(56) References Cited

U.S. PATENT DOCUMENTS 3,712,091 A 1/1973 Parent
5,406,257 A 4/1995 Saito
(Continued)

FOREIGN PATENT DOCUMENTS

DE 44 30 377 A1 2/1996
DE 4430377 * 2/1996
(Continued)

OTHER PUBLICATIONS

International Search Report, dated Nov. 19, 2013, from corresponding PCT application.

*Primary Examiner* — Joseph Feild
*Assistant Examiner* — Omar Casillashernandez
(74) *Attorney, Agent, or Firm* — Young & Thompson

(57) ABSTRACT

An anti-theft device includes a constraint component (1) which may be engaged with a locking component (2), in turn including an anti-intrusion containment body (4) which houses an operating clamp (5), the locking component (2) being provided with at least one engagement seat (3) for plug element (1*a*) of the constraint component (1), wherein the anti-intrusion containment body (4) is associated with a similar box-like, auxiliary anti-intrusion body (6), also provided with at least a through-seat (6*a*) for the plug element (1*a*) between which a compartment is defined for a drawer element (7), the drawer element (7) including at least one electronic unit (8) provided with an alarm-generating device and with at least a position and/or attitude detection sensor.

17 Claims, 6 Drawing Sheets

(58) Field of Classification Search
USPC ..... 340/572.1; 70/277, 275
See application file for complete search history.

(56) References Cited

U.S. PATENT DOCUMENTS

| | | | | |
|---|---|---|---|---|
| 7,325,425 | B1 * | 2/2008 | Miller | E05B 67/38 340/541 |
| 8,400,295 | B1 * | 3/2013 | Khaira | G06Q 50/22 340/10.1 |
| 2003/0179075 | A1 | 9/2003 | Greenman | |
| 2008/0053172 | A1 * | 3/2008 | Foti | E05B 45/005 70/277 |
| 2009/0308118 | A1 * | 12/2009 | Antonucci | E05B 1/0092 70/277 |
| 2010/0173604 | A1 * | 7/2010 | Hofmann | G08B 27/008 455/404.1 |
| 2011/0259063 | A1 * | 10/2011 | Foti | E05B 45/005 70/344 |

FOREIGN PATENT DOCUMENTS

| | | | | |
|---|---|---|---|---|
| DE | 296 09 609 | U1 | 9/1996 | |
| GB | 2 480 062 | A | 11/2011 | |
| IL | WO 2012042515 | A1 * | 4/2012 | E05B 39/00 |
| WO | 2005/069241 | A1 | 7/2005 | |

* cited by examiner

ALARMED THEFT-PREVENTING DEVICE

FIELD OF THE INVENTION

The present invention relates to an anti-theft device with an improved structure. In particular, it relates to a mechanic padlock which may be employed in a variety of different applications, such as vehicles and motorcycles, to represent an effective anti-theft means, also from a remote distance.

STATE OF THE PRIOR ART

It is known that in the world of cycles and motorcycles, protection against theft is a serious, deeply felt issue, which is traditionally addressed by using a chain and padlock.

In cycles or motorcycles, the chain is caused to pass through a wheel and through the frame gaps, and then the two ends thereof are mutually connected through a padlock. Alternatively, the chain or the padlock itself may be connected to a fixed ground reference, such as a post or a suitable anchor.

According to a fully similar principle, so-called disc-lockers are also on offer on the market, which in fact are mechanic padlocks which close onto the brake disc of a motorcycle, exploiting the holes found on the disc itself. Similar mechanic systems are offered as anti-theft device to be applied to the steering wheel or to the pedals of a car.

All these mechanic devices have the advantage of being applicable to and detachable from the vehicle in a simple and intuitive manner, as well as relying for their effectiveness on their intrinsic sturdiness: in substance, in order to be able to perform a violation, the ill-intentioned person must exercise a remarkable effort prolonged in time, which tends to be a dissuasive factor.

For such purpose, reference standards exist which establish the effectiveness of a padlock precisely based on the time required by the ill-intentioned person to make inoperative the anti-jack function of the service.

If moreover they are of a small size, such as padlocks or disc-locks, they are also easily portable and movable between the various vehicles.

Since they are tools which are applied only during vehicle stop, they may be built with the shape and bulk most suited to guarantee the sturdiness thereof. When they are not used, they are then stored in a storage trunk or container which is not part, per se, of the vehicle structure.

The limit of these tools, however, lies in the fact that, with suitable tools and having time available, they may be made ineffective without triggering any signal evident to people.

Moreover, a cycle or motorcycle protected through a padlock or disc-lock not anchored to the ground, may be stolen by simply lifting them and transferring them to a suited place where means and time are available to act comfortably.

As an alternative to these mechanical tools, the use of alarmed anti-theft systems, substantially of an electronic type is also known. These tools rely for their effectiveness on the issue of visual/sound signals which are clearly evident to passers-by or to the owner himself/herself. In motor vehicles—and especially in the most expensive ones, such as luxury cars or lorries which carry valuable goods—but also in motorcycles, as a matter, of fact it is known to employ detection systems for the jacking attempt which are sensitive to vibrations, to movement or to presence; they act either locking the engine or activating a visual/sound signal (for example alarm sound). Systems of this type are also known which issue a signal to a communication network (typically the GSM telephone network), so as to reach the owner even when he/she is at a distance.

These systems generally comprise sensors, capable of detecting the jacking attempt (detecting for example a displacement) and of activating a telephone line to warn (through a voice notice or through a short-text message) the owner of the motor vehicle and/or a surveillance service and/or the police. To this warning function, the position signalling function may be added, operated through a geographic position receiver of the GPS type.

These anti-theft devices are especially configured for the specific vehicle and are typically installed in a fixed manner, exploiting some compartment available on the vehicle. In order to reduce the likelihood of tampering, electronic-type anti-theft devices are typically installed in specific compartments of the vehicle in difficult-to-reach positions and are connected, in a secure manner, to a source of electric supply (typically the vehicle battery). Advantageously, they prevent a theft by simple taking (lifting and shifting) of the vehicle, because they are sensitive to displacement.

However, electronic anti-theft devices imply the technical difficulty of identifying a hidden position in the motor vehicle, in which to install the control unit, the sensors and the signal units—which is even more complex on motor cycles—they imply remarkable costs, provide no portability or interchangeability between vehicles and give rise to jacking opportunities through electronic systems (which hence act with little effort and reduced time).

Problem and Solution

The problem at the basis of the invention is therefore to propose an improved structure of safety device, which is an effective jack-preventing means for various types of vehicles (in a universal way) and which has, at the same time, a high intrinsic sturdiness, so as to suitably protect the alarm elements. A further object is that of providing an alarm device which, despite being suitably protected from jacking attempts, succeeds in transmitting via radio even to a long range, with no shielding problems.

BRIEF DESCRIPTION OF THE DRAWINGS

Further features and advantages of the invention will in any case be more evident from the following detailed description of some preferred embodiments, given purely as a non-limiting example and illustrated in the attached drawings, wherein.

DETAILED DESCRIPTION OF THE CURRENTLY PREFERRED EMBODIMENTS

Figure 1:
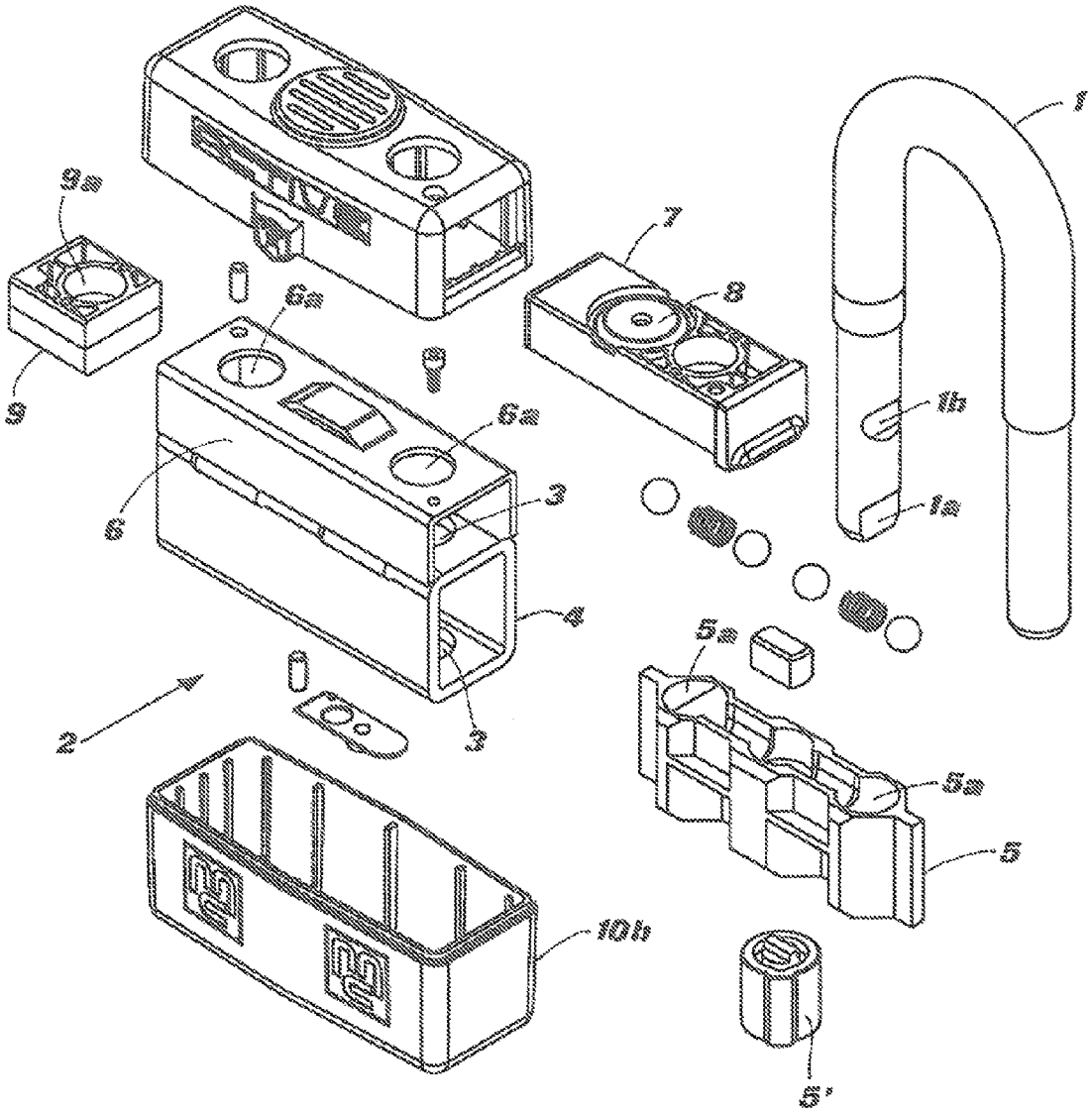
FIG. 1 is an exploded view of the different components of the device according to a first embodiment.
Figure 2:
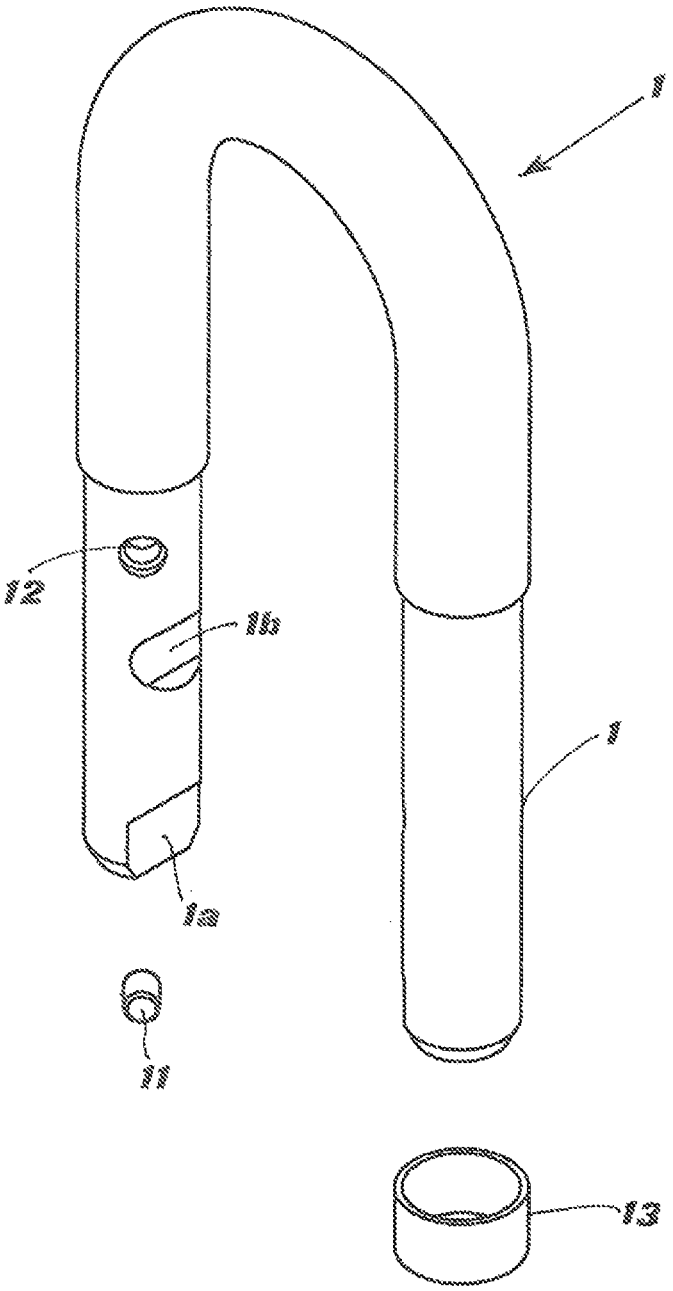
FIG. 2 is a partly-exploded, perspective view of the fork-shaped component according to the invention.

In FIGS. 1-4 a first exemplifying embodiment of the invention is illustrated. As shown, a safety padlock device comprises, in a manner known per se, a constraint component 1, shaped for example as a U-fork (as in the drawings), meant to be associated with a locking component 2, in turn consisting of a containment body 4 and of an operating clamp 5.

Again in a known manner, constraint component 1 has bevels 1*a* and notches 1*b*, arranged along two engagement arms, meant to cooperate with operating clamp 5 to determine the engagement or disengagement between constraint device 1 and locking component 2, so as to close or open the padlock.

Further construction and operation details of the engagement/disengagement mechanism of clamp 5 with U-shaped fork 1, typically enabled by a key block 5', are not supplied here, since they are known to the person skilled in the field and they do not specifically form an object of the present invention.

Please notice that locking component 2 has housing seats 3, wherein the arms of fork 1 are meant to insert to then engage with clamp 5.

Figure 3:
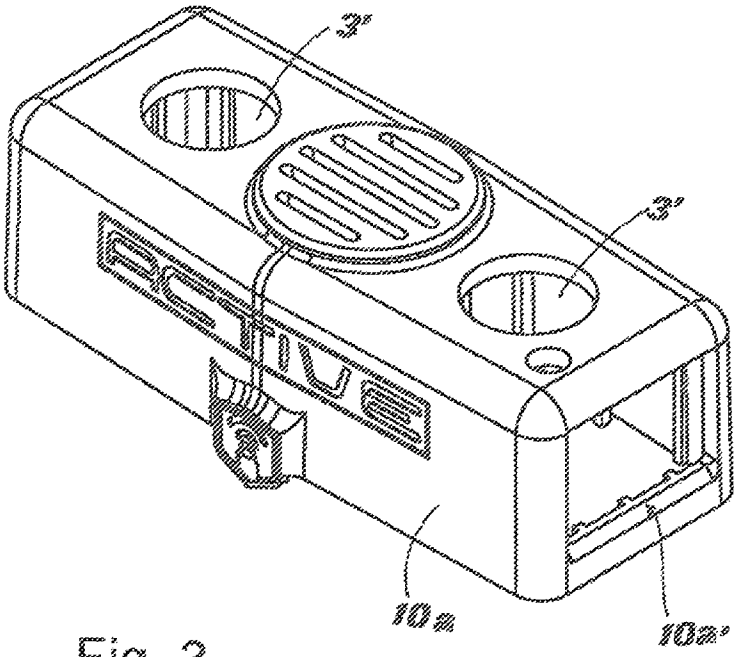
FIG. 3 is a perspective view of an upper cover box of the device according to FIG. 1.

As clearly illustrated in FIG. 3, locking component 2 mainly consists of a box-like containment body or rigid case 4, for example consisting of a segment of square-section tubular profile, with such dimensions and thickness as to be a highly robust element, apt to protect the integrity of clamp 5 inserted therein. In substance, containment body 4 acts as anti-burglar element for the respective clamp, which it guarantees the integrity of.

For example, case 4 is made of steel and has a size of 30×40×100 mm with a 4-mm-thick wall.

On the upper wall of case 4 apertures 3 are practised, which represent the insertion seats of the arms of fork 1.

Within case 4 the clamp 5 (known per se) is housed, which in turn has apertures 5*a* aligned with apertures 3 for the housing of the ends of fork 1, for the cooperation with the locking mechanism of constraint device 1.

According to this first embodiment of the invention, adjacent to main case 4, in particular above the same (i.e. in the direction in which the two arms of fork 1 project), an auxiliary case 6 is joined. Said auxiliary case has a similar shape to that of the main case, i.e. it has a tubular profile of a material suited to make it resistant to violation attempts, for example made of steel. In the illustrated variant, auxiliary case 6 consists of a C-shaped profile, welded along the wings of the profile to the below-lying main case 4.

It too is provided with apertures 6*a*, aligned with apertures 3 and 5*a*, to allow the insertion of the arms of constraint component 1.

Similarly to main case 4, auxiliary case 6 also has lead-in apertures at the two ends thereof.

According to an essential feature of the invention, inside auxiliary case 6 a drawer element 7 is housed, which may be slidingly inserted, preferably from one of the two ends.

Figure 4:
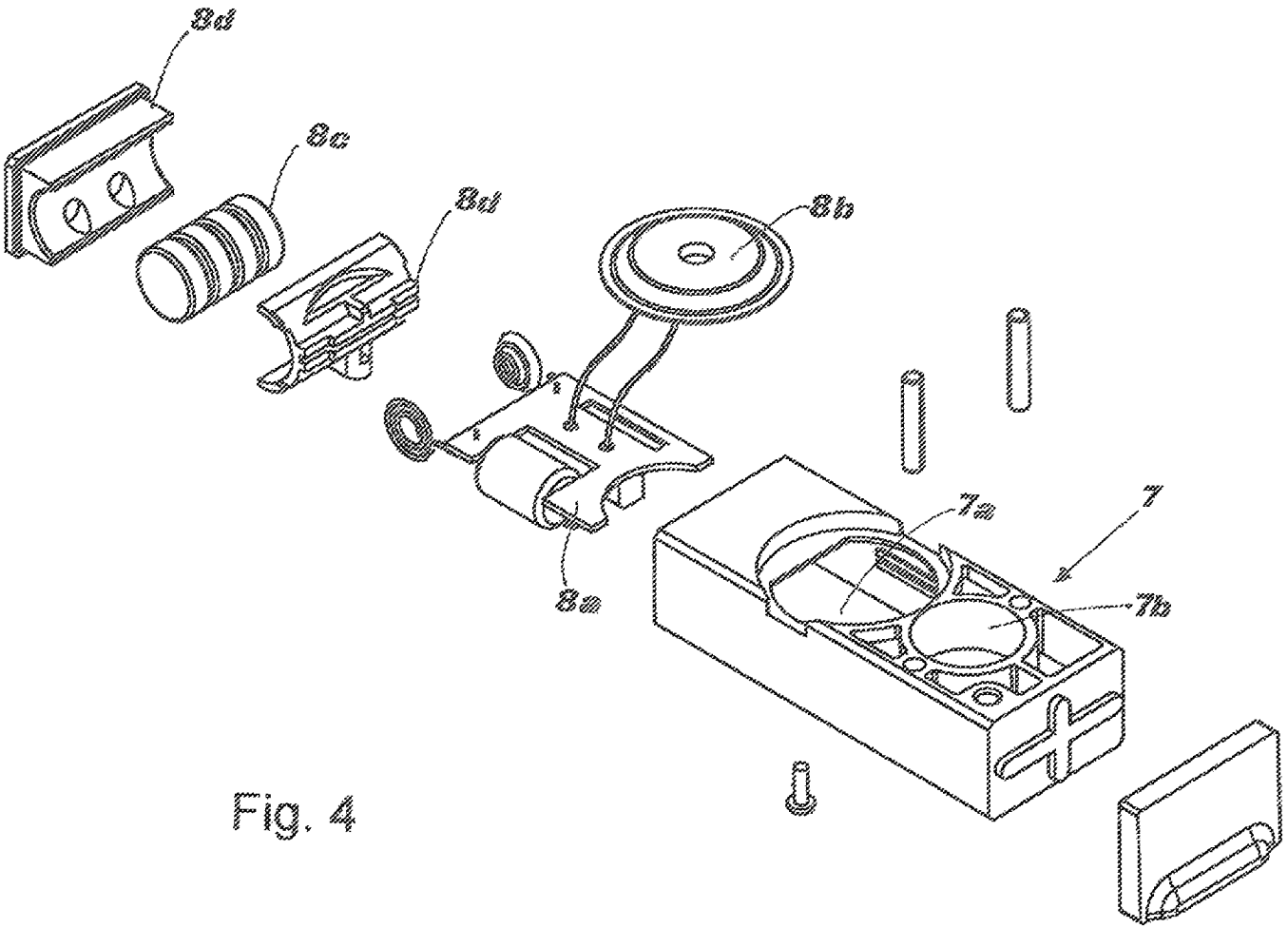
FIG. 4 is an exploded view of the alarm component of the device according to the embodiment of FIG. 1.

Drawer 7, illustrated in particular in FIG. 4, is provided with at least one central housing 7*a* and with a passage 7*b* meant to align with one of the pairs of apertures 3, 5*a*, 6*a*, to allow the insertion of one of the arms of fork 1.

In central housing 7*a* an electronic alarm unit is mounted, shown in FIG. 1 in its entirety under reference 8.

This electronic unit comprises an electronic card 8*a*, provided with at least one alarm device and with at least one position detection sensor, such as for example a movement sensor or a GPS receiver. As movement sensor it is possible to use for example a commercial inclinometer or, preferably, an accelerometer. An accelerometer is more precise than an inclinometer as well as advantageously allowing to adjust the sensitivity level of the system: that allows to take into account the specific environmental conditions of the different contexts of use of the device (car, motorbike, boat, . . . ).

The alarm device may comprise at least a sound signaller.

According to this embodiment, the alarm device preferably also includes a telephone-network radio transmission unit, such as for example a transmitter according to one of the recognised telephone standards (GSM, GPRS, UMTS, . . . ), or a satellite transmitter. Should the transmitter comprise a radio unit for mobile telephones, the drawer device also comprises a housing with a corresponding entry slot for a SIM card, for example a rechargeable data SIM card which the telephone carriers offer on the market at very low prices.

For such purpose, the electronic unit also comprises an electric accumulator (battery) 8*c*, with corresponding support means 8*d*. It may be a replaceable battery, possibly rechargeable through a suitable charger to be properly supplied.

This module 8 may be manufactured as simple GSM/GPRS communication system which, associated with said position detection sensor, sends an alarm signal in the form of SMS message to the portable telephone of the device owner or possibly to a surveillance organisation or to the police. The identification code of the device to contact (typically the owner's telephone number) may be set in a small memory unit integrated in unit 8, for example through a mini-USB or micro-USB interface mounted on drawer 7.

The logic part of electronic unit 8 is configured so as to detect an alarm signal, coming from the position detection sensor when it detects a change of attitude of the device (after the activation thereof), and hence to issue an alarm signal, causing a sound to be generated through the sound signaller and/or activating the transmission unit for the sending of an alarm message through the radio transmission network. Should a GPS module also be provided, the alarm device provides to send also the geographic coordinates detected by the GPS module together with the alarm message, possibly repeating the message sending at regular intervals (for example every 15 minutes).

According to a preferred aspect of the invention, the activation of electronic unit 8 does not require the presence of a switch accessible from the outside, but is caused by the specific introduction of constraint component 1 in containment body 4.

In particular, on one of the two arms of fork 1 a seat 12 is provided with which an insert of magnetic material 11 is provided, which is proximity detected by the electronic unit. If the fork arms are inserted in apertures 3 so that magnetic insert 11 is found in hole 7*b*, i.e. is closely next to card 8*a*, the alarm module activates itself. If instead the fork is inserted in the opposite way, i.e. with magnet 11 inserted in the opposite hole, i.e. further away from card 8*a*, then the module does not activate itself.

For such purpose, fork 1 has an evident mark which helps the user to identify what its insertion position is in body 2 which activates the alarm system; for example, such mark is in the shape of an identification ring 13 (of a different material and/or colour from that of fork 1) inserted in the leg opposite to the one on which magnetic insert 11 is provided. If the fork is inserted mutually inverting the two arms in respective apertures 3, the magnetic insert does not position itself in seat 7*b* and is not detected by the electronic unit: said unit is hence not activated and the device simply acts as a traditional mechanic padlock.

In the exemplifying embodiment illustrated in the drawings, drawer module 8 is of a short length, having housing 7*a* and a single aperture 7*b* for the introduction of one of the arms of fork 1. In such case, to complete the compartment of auxiliary case 6 and determine a good protection and constraint of unit 8, a terminal closing body 9 is also provided—provided with an aperture 9*a* for the introduction of the other arm of fork 1—to be fitted to the compartment of auxiliary drawer from the lead-in opposite to the introduction one of unit 8.

Alternatively, drawer 7 might be formed long enough to have also a second aperture for the arms of fork 1 to pass through.

On the outside of main case 4 and of auxiliary case 6, it is advantageously provided a finishing box-like body, for example made of plastic, which attributes to the device of the invention an aesthetically pleasant outside aspect. As shown, a covering upper box 10*a* (FIG. 3) is provided, which substantially encloses auxiliary case 6, leaving end apertures 10*a*' for the introduction of drawer 7, and a covering lower box 10*b*.

Finally, according to a further original aspect of the invention, it must be considered that the constraint component 1 is not necessarily in the shape of a traditional U-shaped fork (as illustrated in the drawings), but can take up different shapes depending on the specific use which one wants to make: the constraint component may be a pin, a shaped rod, a metal rope or other. The device may furthermore be supplied as a set, comprising a single alarmed locking body and a series of different constraint components, such as a U-shaped fork, a disc-locking jaw, an immobilising rod for the steering wheel of a car, a flexible chain with two engaging heads, and so on. In the anti-theft set a plurality of U-shaped forks of different lengths and widths may also be simply provided, hence adjustable to different uses (from the classic padlock for brake disc, to the immobiliser of a steering wheel, to the locking of an off-board engine for boats, and so on).

Thereby, the device is suited to a number of uses depending on the specific requirement which the user has during use. This makes the device universally applicable on different vehicles of a user, such as the car, the motorvehicle or the bicycle (but also, possibly, a commercial vehicle or a large articulated lorry), despite still offering the same level of safety both from a mechanical point of view and from a remote alert point of view.

As can be clearly understood, the device according to the invention, exploiting the intrinsic resistance of a mechanic padlock, hence offers an unrivalled double level of security and flexibility of use. The presence of two plug means of the constraint component, typically the arms of the U-shaped fork, once engaged with the resistant containment body, define a highly effective protection cage also for the drawer-like electronic unit which remains inserted and protected between the two plugs. The interchangeability of different constraint components, which act both as passive, mechanical locking means of the vehicle, and as secure protection of the electronic components (which instead provide an active protection), makes the application of the device universal also on vehicles which would normally require a dedicated installation of the alarm system.

Figure 5:
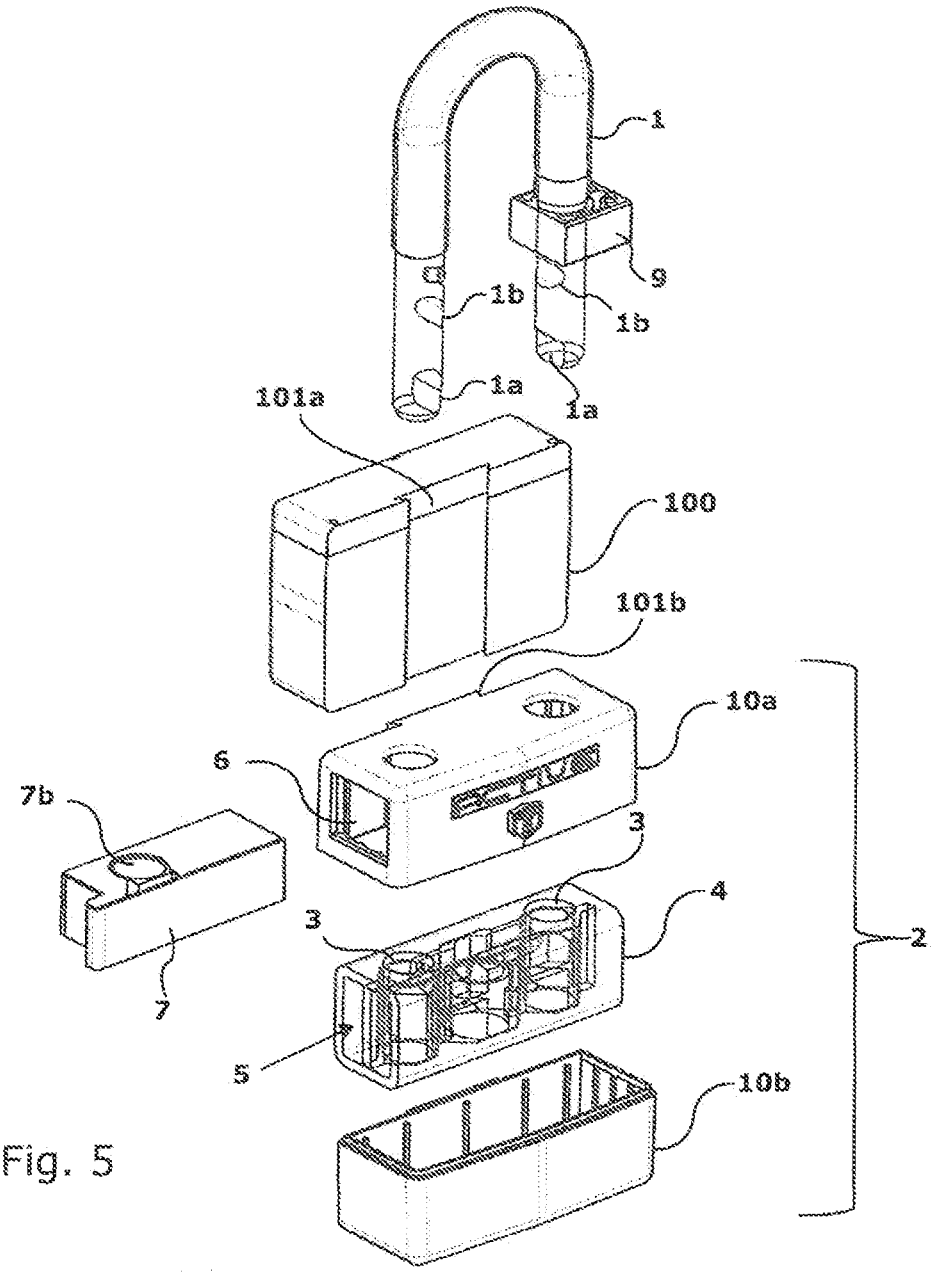
FIG. 5 is an exploded view of the different components of the device according to another embodiment.
Figure 7:
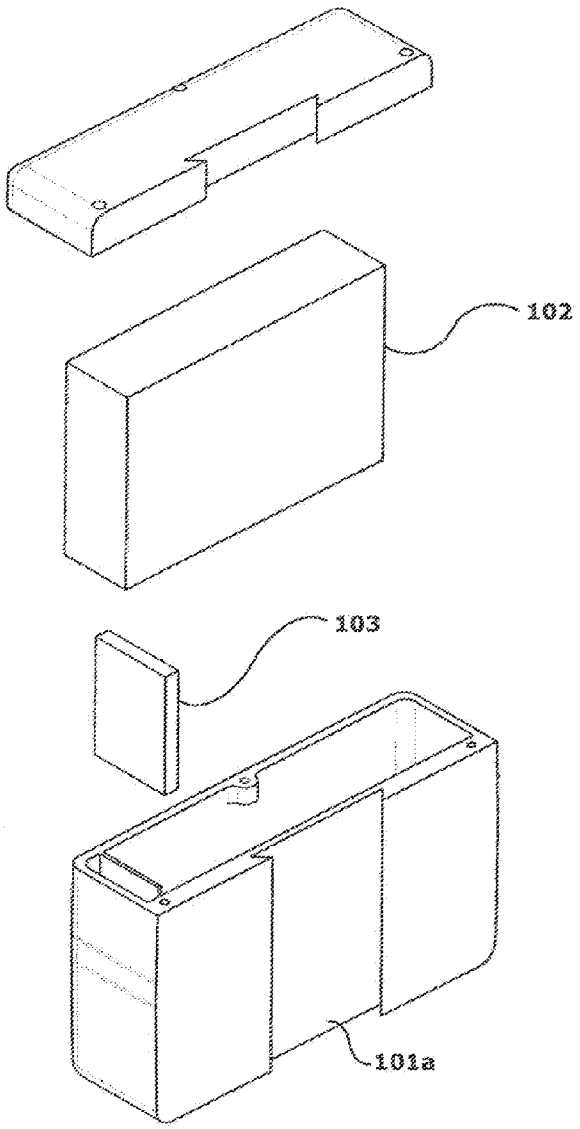
FIG. 7 is an exploded view of the drawer-like component of FIG. 5.
Figure 6:
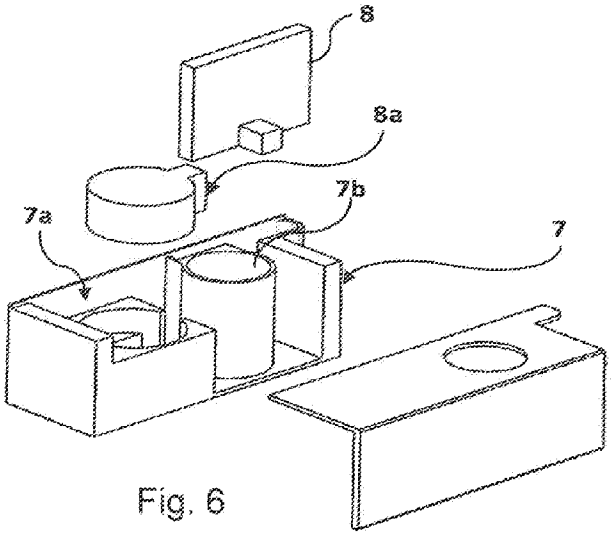
FIG. 6 is an exploded view of the removable component illustrated in FIG. 5.

FIGS. 5-7 show a further preferred embodiment, wherein like numbers refer to like elements with respect to the preceding embodiment.

In this case, too, a constraint component 1 is provided, shaped for example as a U fork (as in the drawings), meant to be associated with a locking component 2, in turn consisting of a containment body 4 and of a clamp 5 which may be actuated (for example with a key lock).

Constraint component 1 has bevels 1*a* and notches 1*b*, arranged along two engagement arms, meant to cooperate with actuatable clamp 5 to determine the engagement or the disengagement between constraint device 1 and locking component 2, so as to close or open the padlock.

Locking component 2 has housing apertures 3, wherein the arms (plugs) of fork 1 are meant to insert to then engage with clamp 5.

Locking component 2 consist mainly of a box-like containment body or rigid case 4, consisting for example of a square-section tubular segment, of such a size and thickness as to represent a highly resistance element, apt to protect the integrity of the clamp 5 inserted inside thereof.

On the upper wall of case 4 apertures 3 are practised, which represent the seats of insertion of the arms of fork 1.

Adjacent to main case 4, in particular above the same (i.e. in the direction in which the two arms of fork 1 extend), an auxiliary case 6 is joined. Said case has a similar shape to that of the main case, i.e. it has a box-like/tubular profile of a material suited to make it resistant to violation attempts, for example steel. For example, auxiliary case 6 consists of a C-shaped profile, welded to below-lying main case 4 along the wings of the profile.

It too is provided with apertures aligned with apertures 3, to allow the insertion of the arms of constraint component 1.

Similarly to main component 4, also auxiliary case 6 has at least a lead-in aperture at one of the two ends (the one visible in FIG. 5).

In this case, too, inside auxiliary case 6 a drawer element 7 is housed, which may be slidingly inserted, for example from the lead-in aperture.

Drawer 7, illustrated in particular in FIG. 7, is provided with a housing 7*a* and a passage 7*b* meant to be aligned with one of the pairs of apertures 3 to allow the insertion of one of the arms (plugs) of fork 1.

In central housing 7*a* an electronic alarm unit is mounted. Said unit, according to this embodiment, comprises only an attitude/movement detection sensor, which does not require long-distance communication units. As movement sensor it is possible to use for example a commercial inclinometer.

In addition to a possible sound signaller, alarm device 8 comprises a short-range RF (radio frequency) transmission unit, such as for example a standard transmission module (for example supplying Bluetooth® technology) or developed with proprietary transmission technology. In housing 7*a* an electric battery 8*a* is furthermore provided for the supply of device 8. It may be a replaceable battery, possibly rechargeable through a suitable charger to be properly supplied.

On the outside of main case 4 and of auxiliary case 6, a finishing box-like body is advantageously provided, for example made of plastic, which attributes to the device of the invention an aesthetically pleasant outer appearance. As shown, a covering upper box 10*a* is provided, which substantially encloses auxiliary case 6, and a covering lower box 10*b*.

According to this embodiment, an auxiliary package 100 is furthermore provided, which may be removably associated with locking component 2, containing electronic units apt to implement long-range transmission, i.e. in the order of over 1 km. For such reason, the auxiliary package is also called communicator module in the following.

Communicator module 100 is configured so as to be securely associated with the locking component, but in an easily removable way: as illustrated in the drawings, provisional coupling means are for example provided, in the shape of a swallow-tailed saddle, part 101*a* on package 100 and part 101*b* on the covering 10*a* and 10*b* of component 2.

Communicator module 100 is suitably fabricated as closable containment body, of a material which has a low absorption of electromagnetic waves at the operating frequencies of long-range radio communication means, such as GPS modules and especially radiotelephony modules such as GSM/GPRS/UMTS. A suitable material is any one plastic material, for example ABS, which is sufficiently transparent to radio transmissions, albeit at the price of a reduced resistance.

As shown in FIG. 3, communicator module 100 contains at least a long-range communication unit 102 and a short-range RF transmission unit 103, designed to exchange data via radio with the corresponding RF communication unit 8 installed inside auxiliary case 6. Unit 102 necessarily includes data communication means, by which it is possible to transmit data (on mobile telephony network, or satellite, or other) to a telephone or other client device accessible by the user. Preferably unit 102 also includes a GPS communication unit, which allows to collect data for the geo-localisation of the system and to pass them to the data communication means.

Should unit 102 include communication means which exploit the standard mobile telephony, the drawer device also comprises a seat with relative slot for the introduction of a SIM card, for example a rechargeable data SIM card, which telephone carriers offer on the market at very low prices.

Also in communicator module 100 there are provided electric batteries, similar to those described above, for the supply of communication unit 102 and of short-range RF transmission unit 103.

The two RF transmission units, 8 and 103, are arranged so as to communicate with each other and to transfer the data generated by the attitude sensor, included in the unit 8 installed in auxiliary case 6, to long-range communication unit 102, which may in turn transfer corresponding (alarm) data to remote receiver units (for example the user's mobile telephone). For such purpose, the RF transmission units may be low-power, because it is sufficient for them to operate with low capacity, in the order of a few metres. In such conditions they are also little affected by the solid shielding provided by auxiliary case 6, which is typically made of metal material.

The logic part of the two electronic modules, one 8 contained in auxiliary case 6 and the other 102 contained in communicator module 100, is configured so as to detect an alarm signal, coming from the position/attitude sensor when it detects an unusual change of attitude of the device (following the activation thereof), to communicate it through RF from the inside of auxiliary case 6 to the RF module 103 within auxiliary package 100, and hence to issue a sound through the sound signaller and/or to trigger the sending of an alarm message through the data communication means included in long-range communication unit 102.

Should also the GPS module be provided, the alarm device provides to send also the geographic coordinates detected by the GPS module together with the alarm message, possibly repeating the sending of the message at regular intervals (for example every 15 minutes).

Moreover, the RF units communicate with each other at regular intervals and may also transfer to each other system status data, for example data relating to malfunctioning of some component/internal unit (for example because tampered with) or energy levels of the electric accumulators, which are usefully sent to the user's client as index of a request for intervention. Moreover, for energy saving, communicator module 100 is preferably provided with a turn-off switch which acts via software, i.e. it is not directly connected in a mechanical way with the accumulator supply: upon turn-off, a corresponding signal is issued towards the long-range communication unit 102, so that the user is notified of the turn-off and can possibly detect a violation attempt.

In synthesis, not only can the attitude detection signal be translated into an alarm signal, but also a variety of system conditions may generate signals to be sent through the long-range communication unit 102, so that the user receives a wide range of signals from which he can desume the need for action.

Moreover, preferably, a single communicator 100 may be configured to communicate at a short distance with a plurality of electronic alarm units 8 belonging to an equal number of containment blocks 4 with relative constraint components. That allows to arrange, for example, multiple padlocks in a same environment (workshop, garage, warehouse, . . . ) which are associated with a suitably arranged single communicator module 100. The association of a communicator module 100 with a plurality of electronic units 8 may be accomplished via software, through a suitable configuration by the user.

For such purpose, in communicator module 100 a logic part is provided which is capable of configuring the hardware/software part of the various units and module onboard the system. The logic part is interfaced to the outside, for example, with a mini-usb connector (preferably installed on the surface meant to couple with body 4, so as to remain more protected). Through an application software which runs on a Windows™ operating system (of a PC) or a mobile operating system (for example Android™ installed on a smartphone), the user can easily configure the association parameters of communicator 100 to various electronic units 8, each one provided with unique identification code. In the same way, it is possible to adjust other operation parameters, among which the sensitivity of the accelerometer of the attitude sensor (as seen above), but also the sampling and comparison frequency of the attitude data (to filter any small and frequent orientation changes, attributable to environmental factors and not to violation attempts). Advantageously, it is possible to store in the control logic a plurality of profiles (for example, motorbike1, motorbike2, car, boat, . . . ), each characterised by a suitable choice of the operation parameters, among which the user can choose more easily.

In the use of the device according to this embodiment it is provided that constraint body 1 be secured to the vehicle to perform the traditional locking function thereof. Auxiliary package 100, once the electronic unit thereof has been activated, can be left associated with locking component 2; according to a preferred mode of use, the auxiliary package is instead released from locking component 2—for example causing it to slide on swallow-tailed guide 101*a*—and arranged in another location on the vehicle, suitable concealed to the sight (for example in the car boot), within the radius of action or range of RF units 8 and 103.

In case of a violation attempt, the unusual change of attitude is detected by unit 8, which transmits an alarm signal to the sound emitter and also—through the RF transmission unit—to long-range communication means 102: by said communication means, the alarm signal is transmitted to the user's receiving unit, which may be found also at a great distance from the vehicle. Once the operation of communication means 102 has been launched, even in case the locking component be destroyed (and RF transmission unit with it), the alarm signal continues to be issued by long-distance communication module 102, possibly comprising the continuously updated geo-localisation data.

The objects set forth in the premises are thus perfectly achieved.

In addition to the advantages set forth above, with this embodiment the long-range communication is not shielded by the presence of resistant box-like body 6. Independent auxiliary package 100, despite not being tamper-proof, is of a reduced size and can be easily concealed to the sight in some location of the vehicle or even (if the geo-localisation function is not necessary) carried by the user (provided the user remains within the radius of action of the RF transmission units, for example when the user goes into a café leaving the vehicle parked immediately outside).

However, it is understood that the invention must not be considered limited to the particular arrangements illustrated above, but that other, different variants may be viable, all within the reach of a person skilled in the field, without departing from the scope of protection of the invention, as defined by the following claims.

In the context of the present application, moreover, it is understood that "long range" and "short range" are to be understood with respect to the application, the former being of the order of at least a few hundred meters, the latter being at most of the order of a few dozen of metres. Also, the electromagnetic low-absorption material is to be understood as a material which does not significantly hinder the propagation of the waves of the typical frequency used in mobile telephone communications and in GPS devices. Moreover, although reference has been mainly made to a mobile telephone system, it is not ruled out that long-distance alarm communications occur through other systems to a client device (smartphone, PDA, beeper, . . . ) accessible by the user.

Finally, a support or bracket to be supplied to the user may be provided, to arrange the device on the vehicle when said device is not in use.

The invention claimed is:

1. An anti-theft device comprising:

a constraint component (1) comprising at least one plug means;

a locking component (2) engageable with the constraint component (1), the locking component (2) comprising an anti-intrusion containment body (4) housing an operating clamp (5), said anti-intrusion containment body (4) having at least one engagement seat (3) for said at least one plug means (1*a*) of said constraint component (1), an auxiliary anti-intrusion body (6) associated with said anti-intrusion containment body, said anti-intrusion body (4) having a compartment and at least one through-seat (6*a*) for said at least one plug means (1*a*) of said constraint component (1), said anti-intrusion containment body (4) having a box shape;

a drawer element (7) insertable into said compartment of said auxiliary anti-intrusion body (6), said drawer element comprising at least one electronic unit (8) provided with an alarm-generating device and at least one of the group consist of a position detection and an attitude detection sensor; and a removable communicator module (100) associated with said locking component (2), said removable communicator module being made of a low-electromagnetic-absorption material and housing a long-range communication unit (102) comprising at least data communication means to a communication network accessible from a user's receiver client, and an RF transceiver unit (103) apt to communicate with a corresponding RF transceiver unit included in said electronic unit, an alarm signal being transmitted from said alarm-generating device to said user's receiver client through said RF transceiver units and said long-range communication means (102).

2. The device as claimed in claim 1, wherein said alarm-generating device comprises an antenna (8*b*) and a radio transmitter for sending alarm messages on a communication network accessible from a user's client.

3. The device as claimed in claim 1, wherein said auxiliary anti-intrusion body (6) is arranged on one side of the anti-intrusion containment body (4) towards which said plug means extend in the constraint component (1).

4. The device as claimed in claim 3, wherein said auxiliary anti-intrusion body (6) is in the form of a C-shaped profile, fastened along one side of said anti-intrusion containment body (4).

5. The device as claimed in claims 3, wherein said auxiliary anti-intrusion body (6) is in the form of a tubular profile with dimensions 30×40×100 mm with a 4-mm thick wall.

6. The device as claimed in claim 1, wherein said drawer element (7) has at least one through-aperture (7*a*) for one of said plug means (1*a*).

7. The device as claimed in claim 1, wherein said electronic unit (8) comprises an electronic card (8*a*), provided with at least one movement/displacement sensor and with at least one alarm.

8. The device as claimed in claim 7, wherein said movement/displacement sensor is an accelerometer/inclinometer.

9. The device as claimed in claim 7, wherein said alarm comprises a sound signaller.

10. The device as claimed in claim 7, wherein said movement/displacement sensor comprises a geographic positioning device (GPS) and means for associating geographic position data with said alarm.

11. The device as claimed in claim 1, wherein at least one of said plug means (1*a*) of the constraint component (1) has a permanent magnet (10).

12. The device as claimed in claim 1, wherein said constraint component (1) takes up the shape of a U-shaped fork, or of a flexible chain, or of a disc-locking clamp, or of an immobiliser rod for a motor vehicle.

13. An anti-theft set comprising a device as claimed in claim 1 and a plurality of constraint components (1) comprising at least a U-shaped fork.

14. The device as claimed in claim 2, wherein said auxiliary anti-intrusion body (6) is arranged on one side of the anti-intrusion containment body (4) towards which said plug means extend in the constraint component (1).

15. The device as claimed in claims 4, wherein said auxiliary anti-intrusion body (6) is in the form of a tubular profile with dimensions 30×40×100 mm with a 4-mm thick wall.

16. The device as claimed in claim 8, wherein said alarm comprises a sound signaller.

17. An anti-theft device comprising:

a constraint component (1) comprised at least one plug means (1*a*);

a locking component (2) engageable with constraint component (1),the locking component (2) comprising an anti-intrusion containment body (4) housing an operating clamp (5), said anti-intrusion containment body (4) having at least one engagement seat (3) for the at least one plug means (1*a*) of said constraint component (1);

an auxiliary anti-intrusion body (6) associated with said anti-intrusion containment body (4), said auxiliary anti-intrusion body (6) having a compartment and at least one through-seat (6*a*) for said at least one plug means (1*a*) of said constraint component (1),said anti-intrusion containment body (4) having a box shape;

a drawer element (7) insertable into said compartment of said auxiliary anti-intrusion body (6), said drawer element (7) comprising at least one electronic unit (8) provided with an alarm-generating device and at least one of the group consisting of a position detection sensor and an attitude detection sensor, wherein, with the drawer element (7) in said compartment of said auxiliary anti-intrusion body (6) and the plug means (1*a*) of the constraint component (1) being engaged with said anti-intrusion containment body (4), a cage is defined for said drawer element (7) including the electronic unit (8) which remains inserted and protected, and wherein said drawer element (7) has at least one through-aperture (7*a*) for one of said at least one plug means (1*a*).

* * * * *